US006662763B1

(12) United States Patent
Tafoya

(10) Patent No.: US 6,662,763 B1
(45) Date of Patent: Dec. 16, 2003

(54) DE' SAX' E TWO CYCLE ENGINE, CONSTANT PRESSURE ADIABATIC COMPOUND "C.P.A.C."

(76) Inventor: Samuel Barran Tafoya, 135 41st Cir. E., Bradenton, FL (US) 34208

( * ) Notice: Subject to any disclaimer, the term of this patent is extended or adjusted under 35 U.S.C. 154(b) by 0 days.

(21) Appl. No.: 09/960,141

(22) Filed: Apr. 2, 2002

(51) Int. Cl.[7] ..... F02B 75/02

(52) U.S. Cl. ..... 123/65 VB; 123/65 BA; 123/268; 123/275

(58) Field of Search ..... 123/65 B, 65 BA, 123/65 VB, 69 R, 69 V, 70 V, 71 V, 257, 260, 261, 266, 268, 274–278, 286

(56) References Cited

U.S. PATENT DOCUMENTS 5,027,757 A * 7/1991 Pusic ..... 123/65 VB

* cited by examiner

*Primary Examiner*—Noah P. Kamen
(74) *Attorney, Agent, or Firm*—Dorothy S. Morse

(57) ABSTRACT

A reversible heat, constant pressure 2-cycle engine that takes ambient air and heats it up before mixing it with fuel, so that even a very lean mixture of air and fuel is highly combustible, to provide increased fuel economy and decreased fuel consumption when compared to conventional 4-stroke engines. Once a power stroke occurs with the very lean mixture, exhausted hot gases are directed to a turbine wheel. After work is taken from the hot gases and they are no longer combustible, they are returned to the atmosphere at ambient temperature. Also, the two-cycle present invention engine has a power stroke every revolution, instead of every other revolution as in conventional 4-stroke engines, which allows the present invention to be smaller in size while producing twice the power of conventional 4-stroke engines. No valve springs, camshafts, high-pressure fuel pumps, radiators, distributors, or mufflers are required with the present invention engine.

20 Claims, 5 Drawing Sheets

DE' SAX' E TWO CYCLE ENGINE, CONSTANT PRESSURE ADIABATIC COMPOUND "C.P.A.C."

CROSS-REFERENCES TO RELATED APPLICATIONS

None.

BACKGROUND OF THE INVENTION

1. Field of the Invention

This invention relates to the field of engines, specifically to a constant pressure adiabatic compound engine that uses very hot air for induction to attain high fuel efficiency and reduced emissions in exhaust gases. It runs very lean, operates with a wide-open intake, and has an exhaust that is not combustible and returned to the atmosphere at ambient temperature. It also has an offset crankshaft for increased torque and increased thermal efficiency, as well as air intake valves that are opened and closed by pressure differential.

2. Description of the Related Art

Conventional engines, such as the four stroke engines commonly used in motor vehicles, are typically large and burn a rich air/fuel mixture with incomplete combustion that creates polluting exhaust emissions. In contrast, the present invention engine is more cost effective to operate, it depletes energy resources at a much slower rate, and its emissions have significantly less impact on the environment. Cost effective operation results from the present invention burning a very lean air/fuel mixture, as well as the fact that when fully dressed and assembled the present invention utilizes approximately 45% less space by volume while producing twice the power of conventional power plants having the same cubic displacement. The present invention engine reduces fuel consumption by utilizing the potential energy stored in the very hot cooling air used to cool the engine, which is generally wasted as radiator heat by conventional engines. The present invention engine also has an offset crankshaft for increased torque and increased thermal efficiency over conventional four-stroke engines, as well as air intake valves that operate silently and quietly since they are opened and closed by pressure differential. A further difference between the present invention and conventional engines is that the exhaust gases of the present invention engine have substantially reduced emissions, are not combustible, and are returned to the atmosphere at ambient temperature. Motor vehicles with conventional engines also require a camshaft with an expensive valve train, high-pressure fuel pump, radiator, distributor, and a muffler, none of which are required during use of the present invention. There is no engine known with the same features and components as the present invention, nor all of its advantages.

BRIEF SUMMARY OF THE INVENTION—OBJECTIVES AND ADVANTAGES

The primary object of this invention is to provide an engine that is able to bum a very lean fuel/air mixture for high fuel efficiency and economy. It is also an object of this invention to provide an engine that causes near total combustion, thereby reducing exhaust heat and cooling heat as an energy loss. A further object of this invention is to provide an engine that releases exhaust gases to the atmosphere that are not combustible and near ambient temperature. It is also an object of this invention to provide an engine that eliminates many of the parts/accessories required by conventional engines. A further object of this invention is to provide an engine that while smaller in size is able to produce approximately twice the horsepower of conventional engines with similar displacement.

As described herein, properly manufactured and used, the present invention is a cost efficient engine that depletes energy resources at a much slower rate than conventional 4-stroke engines, and has cleaner emissions for significantly less an impact on the environment. The present invention engine reduces fuel consumption by utilizing the potential energy stored in the very hot cooling air used to cool the engine, which is generally wasted as exhaust by conventional engines. It also burns a very lean air/fuel mixture and has an offset crankshaft for increased torque and increased thermal efficiency. Further, air intake valves in the present invention operate quickly and silently since they are opened and closed by pressure differential, instead of requiring the use of a camshaft with an expensive valve train. The potential energy stored in the very hot cooling air is used to warm the induction air that is mixed with the fuel. The hot induction air is then compressed by the piston and forced into the venturi of the injector. The velocity of the hot air educts fuel from the injector and drives the combustible mixture to the spark plug, where it is ignited. The combustible mixture then expands and is forced onto the top of the piston where it explodes into a very lean burn and produces a power stroke. The lean burn permits the complete burning of fuel, and emissions are all but eliminated. The complete burn creates the partial vacuum that is responsible for the opening of the air intake valves, which allow fresh air to again enter the cylinder for the next power stroke. After combustion, as the top of the downwardly moving piston nears the exhaust ports, the air intake valves are still closed. When the exhaust ports are finally uncovered, a pressure drop occurs that causes the air intake valves to open (with manifold pressure behind it). The cylinder is now ventilated with a fresh charge of air to be compressed. As the piston starts moving upwardly again to compress the new charge of hot air, the pressure in the cylinder increases and causes the air intake valves to close. Further, as the piston nears top dead center, air is forced to enter the injector whereby its design lets fuel to enter the air stream due to the venturi. Until it hits the igniter, the fuel and air mixture is in laminar flow. The flow changes to turbulence when the mixture hits the igniter, and only then is it ignited. The exhaust gases exiting the cylinder turn an impeller, the energy of which is directed by a sprag clutch to the crankshaft that moves the pistons. One important difference between the present invention and conventional engines is that the exhaust gases of the present invention engine have substantially reduced emissions and are not combustible. Also, the exhaust gases are returned to the atmosphere at near ambient temperature. Further, motor vehicles with conventional engines also require a camshaft with an expensive valve train, high-pressure fuel pump, radiator, distributor, and a muffler, none of which are required during use of the present invention. When fully dressed and assembled, the present invention utilizes approximately 45% less space by volume while producing twice the power of conventional power plants having the same cubic displacement.

While the description herein provides preferred embodiments of the present constant pressure adiabatic compound engine, it should not be used to limit its scope. For example, variations of the present invention, while not shown and described herein, can also be considered within the scope of the present invention, such as variations in the size of the turbine; the fuel pressure maintained by the low-pressure fuel pump; the ratio of fuel/air used for combustion; the configuration of and type of material used for the air intake valves; the size and number of exhaust ports; and the configuration of the venturi. Thus, the scope of the present invention should be determined by the appended claims and their legal equivalents. rather than being limited to the examples given.

DETAILED DESCRIPTION OF THE INVENTION

Figure 1:
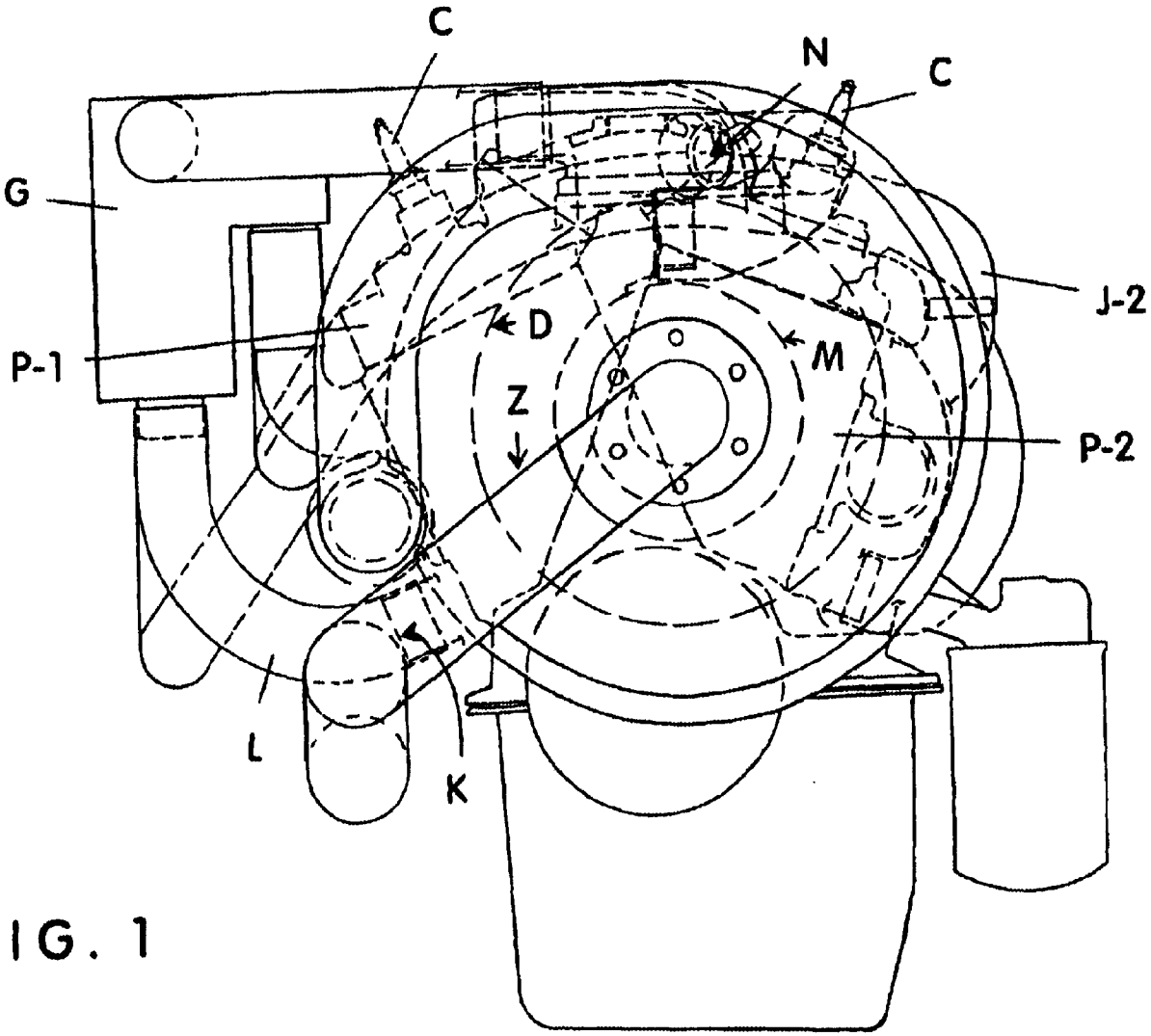
FIG. 1 is a front view of the most preferred embodiment of the present invention constant pressure adiabatic compound engine.

The object of the present invention constant pressure adiabatic compound engine is to burn fuel at a very lean mixture. To do this, the potential energy stored in the very hot cooling air is used to warm the induction air that is mixed with the fuel. The severe pre-ignition normally caused by this type of arrangement is prevented in two ways. First, the crankshaft T is offset and past top dead center when the piston R is at the top of its stroke. Thus, if pre-ignition does occur, it would only cause crankshaft T to rotate in the direction of design that all automotive engines rotate. Second, the igniter C is not timed, as with a distributor, but is a multiple spark system that fires continuously, with the injection of the fuel being coordinated with ignition. The fuel is ignited only when the hot compressed induction air is forced by piston R into the venturi of the injector B; where the velocity of the hot air educts fuel from injector B and drives the combustible mixture to the spark plug (igniter C), where it is ignited. A low-pressure fuel pump (not shown) governs engine speed, and no high-pressure fuel pump is required. Upon reaching igniter C, the flow changes from laminar to turbulent. Ignition can only occur in a turbulent environment. The combustible mixture then expands and is forced onto the top of the piston R where it explodes into a very lean burn and produces a power stroke. The power stoke is started when the burn is leaned with the air in the combustion chamber. The lean burn permits the complete burning of fuel, and emissions are all but eliminated. Further, the air intake valves A are opened and closed by pressure differential. It is the complete burn creating a partial vacuum that is responsible for the opening of the air intake valves A that allows fresh air to again enter the cylinder P for the next power stroke. The offset crankshaft T design increases torque, permitting the piston R to accelerate from the scene of combustion faster, thereby reducing heat transfer to the cylinder heads and the cooling system (including cooling fins F), and increasing thermal efficiency. After combustion, as the top of the downwardly moving piston R nears the exhaust ports S, the air intake valves A are still closed. When the exhaust ports S are finally uncovered, a pressure drop occurs that causes the air intake valves A to open (with manifold pressure behind it). The cylinder P is now ventilated with a fresh charge of air to be compressed. As piston R starts moving upwardly again, the pressure in cylinder P increases and causes the air intake valves A to close. Further, as the piston R nears top dead center, air is forced to enter the injector B whereby its design lets fuel to enter the air stream due to the venturi. Until it hits the igniter C, the fuel and air mixture is in laminar flow. The flow changes to turbulence when the mixture hits igniter C. When ignition takes place, the burn is rich to stoichometric, expanding to return to the combustion chamber (cylinder P) where the bum becomes very lean, generating a power stroke. The energy of ten-inch impeller D being turned by the velocity of the exhaust gases, after the downward power stroke uncovers exhaust ports S, is directed by a one-way sprag clutch E to crankshaft T. The crankshaft T of the present invention engine dues not drive impeller D. Further, the crank journals are laid out to provide 90° power impulses. In addition, since no crankshaft with an expensive valve train is required, lubrication would be simple.

In the most preferred embodiment of the present invention, although not limited thereto, the cylinder heads P are cooled with preheated air coming from a six-inch diameter air pump or blower M, which derives its source of air from an air cleaner (air strainer H). The cooling air initially enters an air strainer H from the atmosphere and then enters the air inlet (via air intake valves A) at the top of the cylinder P, passes down through cylinder P and out the air outlets (exhaust ports S) at the bottom of cylinder P, after which it moves through an air filter G, which preferably has a fine mesh. The six-inch diameter blower M draws this hot air from air filter G and discharges it into an air box N where it is used for combustion products. Air box pressure N opens the air intake valves A near the top of cylinder P, when the exhaust ports S in cylinder P are opened and pressure decay occurs. As the engine warms up and the air inside the cooling walls of cylinders P becomes warm to hot, this air becomes the source of induction to the suction side of the six-inch diameter blower M. This cycle is thermotaxis. The cylinders P are also cooled by the air pump or blower M, which is always running by the engine. This air is then directed to the intake manifolds. The exhaust gases are expelled at velocity and directed to an impeller or turbine wheel D, the energy of which is directed to crankshaft T by one-way sprag clutch E. The exhaust is no longer combustible and after work in the form of heat is taken from the very hot gases, it is returned to the atmosphere at very nearly the same temperature that it was drawn in. In the most preferred embodiment of the present invention, although not limited thereto, impeller D would have a diameter dimension of approximately ten inches. Ignition would be a multiple spark, and no distributor is required. Also, no muffler is required since the exhaust temperature is very close to atmospheric temperature. In addition, cooling fins F are cast within the cooling jackets to increase cooling area, preferably by the lost wax method. The lube pump W is driven externally with the coged belt that drives the six-inch blower M. Further, in the most preferred embodiment of the present invention it is preferred for the offset crank T in relation to the center-line of cylinder P to be approximately one-half inch. Side thrust is comparable to a conventional engine. Preferred material for air intake valves A is inconel or niconel, which are incapable of softening after heating. Fuel pressure controls speed. Air intake valves A open and close rapidly, and are silenced due to the air cushion present prior to seating, with the cushioning on one side provided by blower M and the cushioning on the other side provided by combustion pressure. Further, inertial forces are not equal, since the speed of the piston is greater at the top of the stroke than at the bottom.

Figure 2:
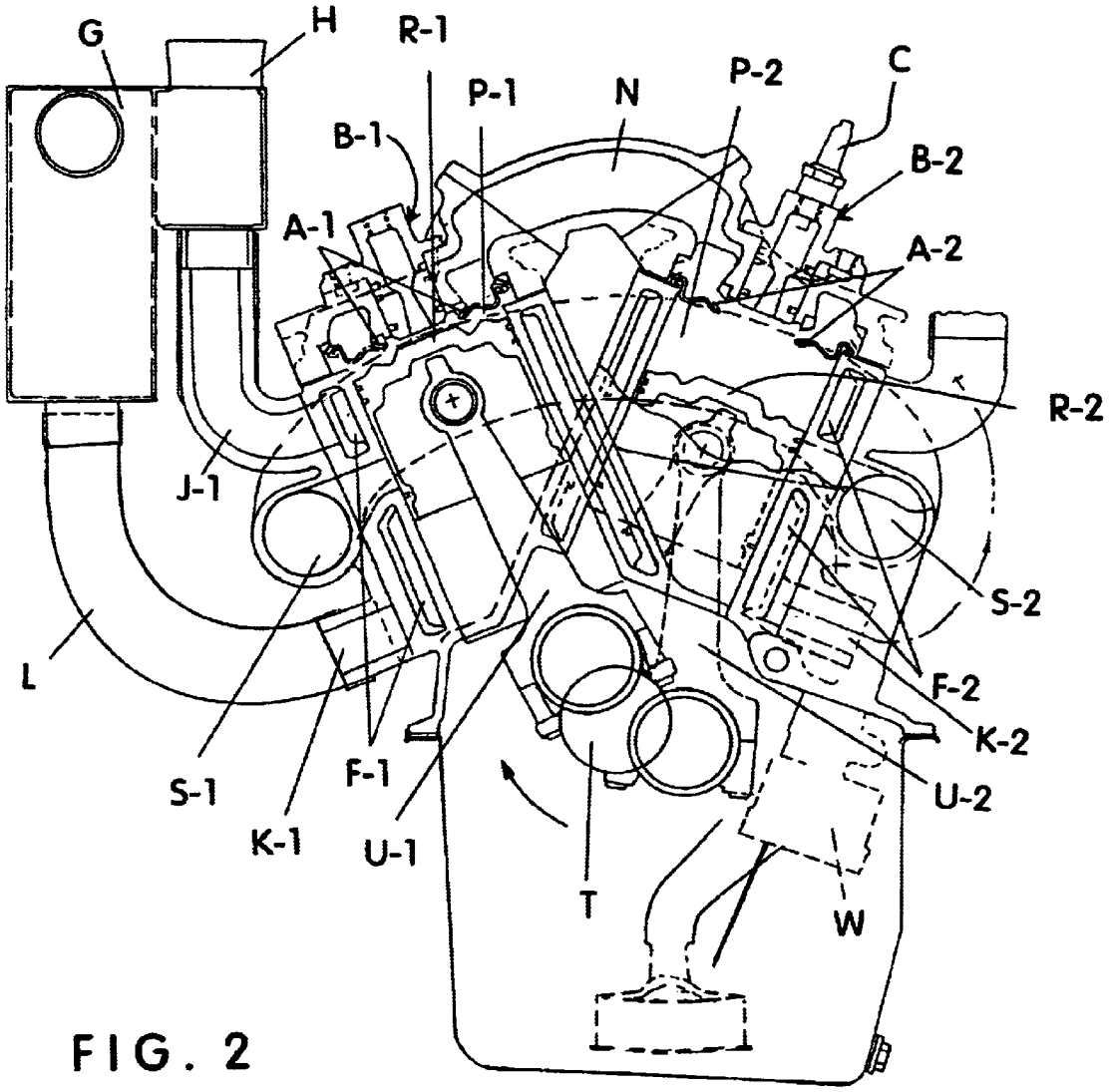
FIG. 2 is a front view of the most preferred embodiment of the present invention engine having its heated air tube connected to an air filter and blower, with the hot exhaust being used to pre-heat atmospheric air before it enters a cylinder.

FIG. 1 is a front view of the most preferred embodiment of the present invention constant pressure adiabatic compound engine, showing two cylinders P-1 and P-2 each with an igniter C extending through its upper surface. The two cylinders P-1 and P-1 are positioned relative to each other so that igniters C are angled away from one another. The air used for combustion in cylinders P-1 and P-2 is drawn from air box N. Although not shown, the most preferred embodiment of the present invention has two additional cylinders, P-3 and P-4 positioned directly behind cylinders P-1 and P-2. FIG. 1 further shows the tubing J-2 used to bring cooling air to the left bank of cylinders (P-2 and the cylinder directly behind P-2). The tubing J-1 used to bring cooling air to the right bank of cylinders (P-1 and the cylinder directly behind P-1) is not shown in FIG. 1, however, tubing J-1 is shown in FIG. 2. Further, a hot air outlet K extends from the bottom portion of each cylinder P. Tubing L connects hot air outlet K to air filter G. Also identified in FIG. 1 are blower M, impeller/turbine D, and the exhaust to atmosphere Z.

FIG. 2 is also a front view of the most preferred embodiment of the present invention engine, which reveals additional features thereof. FIG. 2 show two cylinders P-1 and P-2 each with a connecting rod U that is used to raise and lower the top piston surface R. The lower ends of connecting rods U-1 and U-2 are secured to crank T. Although not shown, it is contemplated for the most preferred embodiment of the present invention to have two additional cylinders, P-3 and P-4, a different one of which is positioned directly behind cylinder P-1 and P-2. Even though components are identified herein only by a letter designation, for ease of identification in FIG. 2, when components are related to a particular cylinder P-1 or P-2, the component will also display the appropriate numeric designation of "-1" or "-2". For example, in FIG. 2 the air intake valves A are individually marked as A-1 and A2, while connecting rods U are individually marked as U-1 and U-2. For illustrative purposes only, cylinder P-2 has an igniter C extending through its upper surface, whereas during operation both cylinders P-1 and P-1 would require an igniter C. FIG. 2 shows each cylinder P-1 and P-2 having a fuel injector B, cooling fins F, and an exhaust port S. In cylinder P-1, both air intake valves A-1 are shown in a closed configuration that blocks air inflow into cylinder P-1, while both air intake valves A-2 are shown in an open configuration that allows air to flow into cylinder P-2. The air used for combustion in cylinders P-1 and P-2 is drawn from air box N. Prior to reaching air box N, the air travels through an air strainer H. FIG. 1 further shows the tubing J-1 and J-2, respectively used to bring cooling air to the right and left bank of cylinders P via cooling fins F-1 and F-2. Although L-s is not shown in FIG. 2, tubing L-1 and L-2 respectively connect hot air outlet K-1 and K-2 to air filter G. Also identified in FIG. 2 is the approximate positioning of oil pump W, which is driven externally by the same coged belt that drives blower M. Since discharge tubing pieces L-1 and L-2 are connected to air filter G and the blower M (shown in FIG. 1), the hot discharge from the most recent combustion event in cylinders P can be used to pre-heat atmospheric air before it enters cylinders P for the next combustion event.

Figure 3:
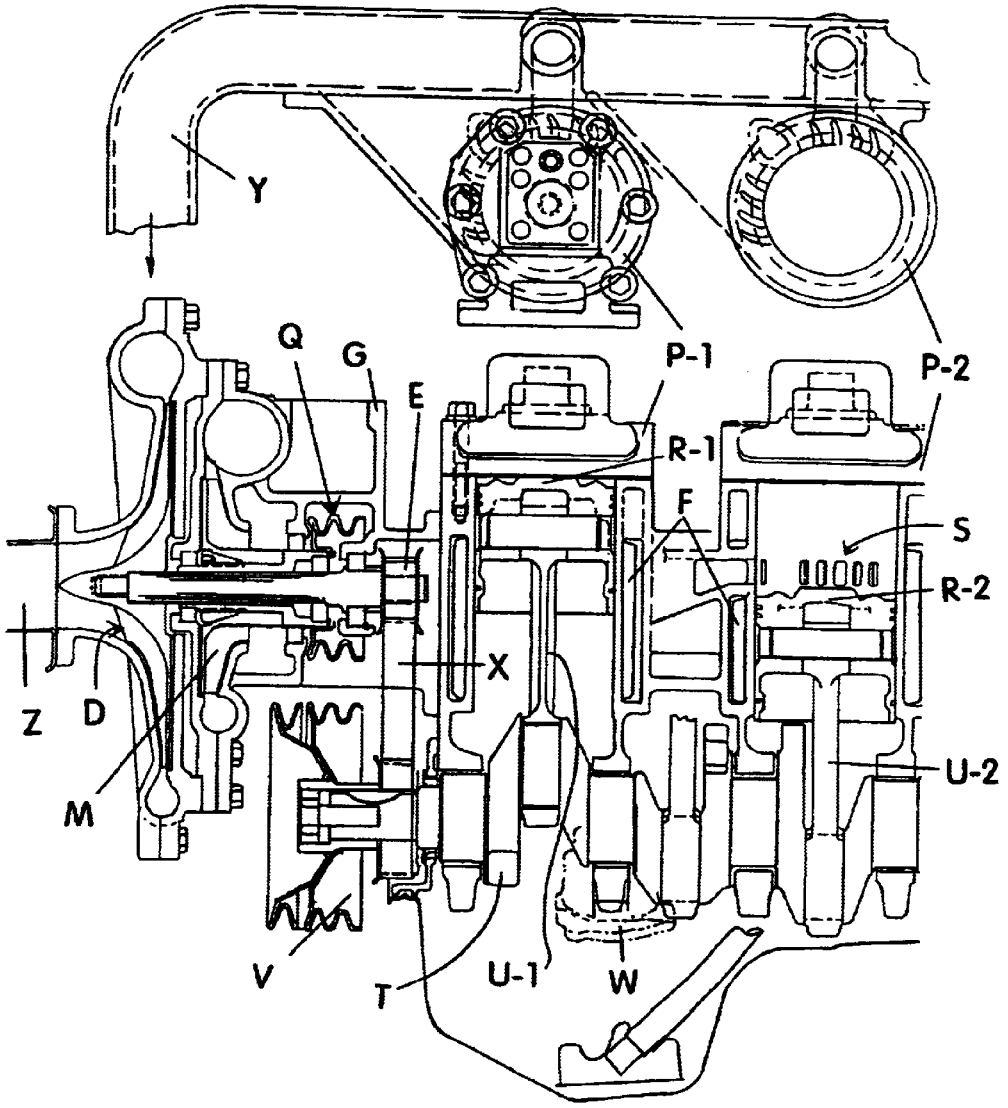
FIG. 3 is a sectional side view of the most preferred embodiment of the present invention engine.

FIG. 3 is a sectional side view of the most preferred embodiment of the present invention engine showing two cylinders P-1 and P-2, each having cooling fins F. In cylinder P-1, the top piston surface R-1 is fully raised and positioned near the top end of cylinder P-1. In contrast, cylinder P-2 is in a fully lowered position revealing exhaust ports S. U-1 and U-2 respectively identify the connecting rods that raise top piston surfaces R-1 -and R-2 so that subsequent power strokes can begin. FIG. 3 also shows the lower ends of connecting rods U-1 and U-2 secured to a crank T, and an oil pump W positioned in the vicinity of crank T. The arcuate counterclockwise arrow adjacent to crank T shows its direction of movement. To the left of cylinder P-1, FIG. 3 shows impeller/turbine D, blower M, and a sprag clutch E and belt X. The exhaust gases (not shown) are expelled from cylinders P at velocity and directed to impeller/turbine D, the energy of which is directed by sprag clutch E and to crankshaft T. For the most preferred embodiment of the present invention, impeller/turbine D is approximately ten inches in diameter and blower M is approximately six inches in diameter. FIG. 3 also shows a crankshaft V-belt pulley V and a compressor V-belt Q between impeller/turbine D and cylinder P-1. To the left of impeller/turbine D, FIG. 3 shows the exhaust to atmosphere Z. Belts X and Q are engine driven.

Figure 4:
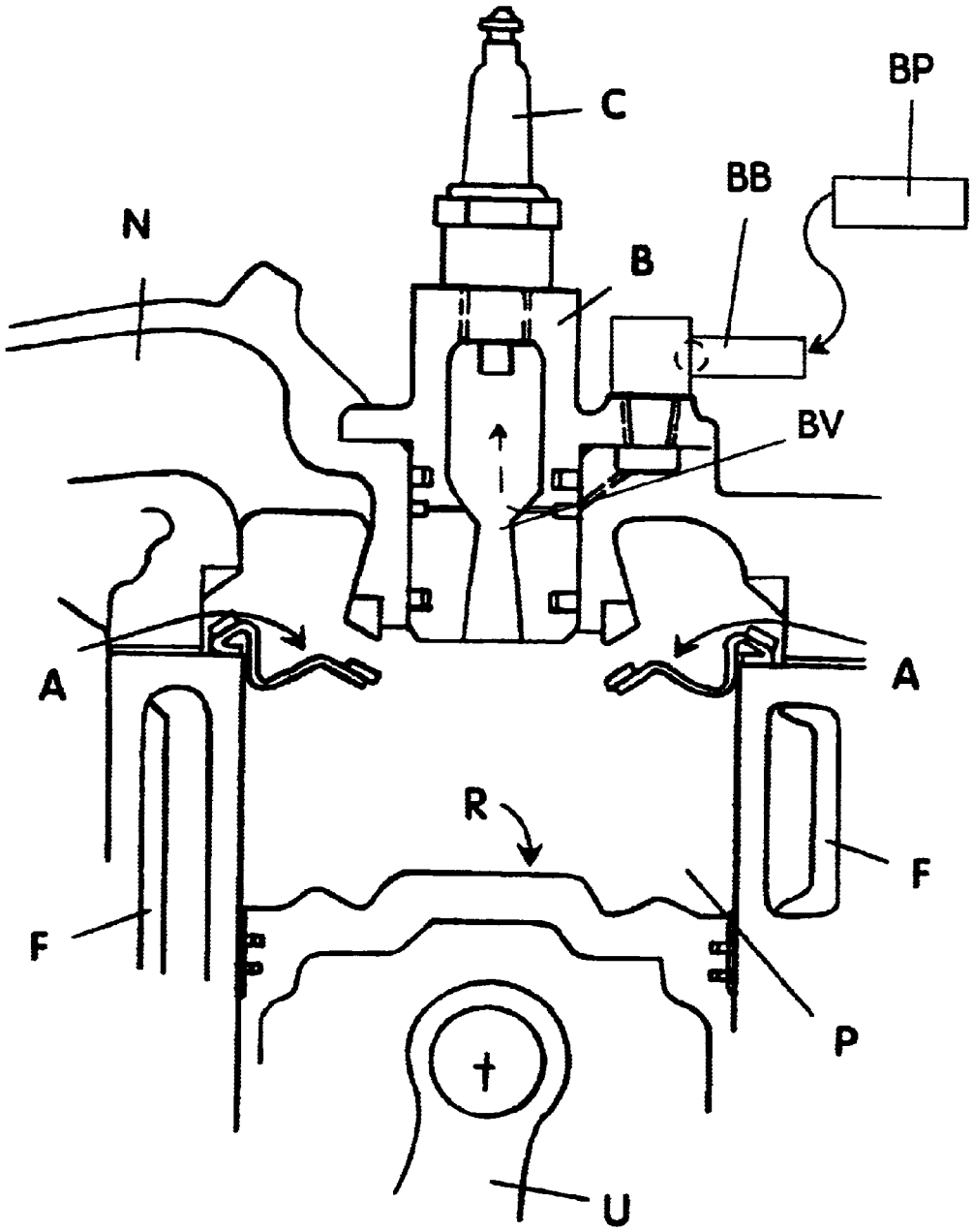
FIG. 4 is an enlarged sectional view of a cylinder in the most preferred embodiment of the present invention engine having its air valves open.

FIG. 4 is an enlarged sectional view of a cylinder P in the most preferred embodiment of the present invention engine having its two air valves A in an open position. After a combustion event, the top piston surface R is lowered within cylinder P. As exhaust ports S (shown in FIG. 2) are exposed by top piston surface K the exhaust gases (not shown) leave cylinder P and are replaced by new air (not shown) from air box N. As connecting rod U again raises top piston surface R, both air intake valves A are forced into a closed position, and the new air is trapped, compressed, and directed toward the precombustion chamber adjacent to igniter C. A low-pressure fuel pump (not shown) adds fuel to the new air in the precombustion chamber communicating with igniter C via fuel injector B, after which igniter C fires and causes the air/fuel mixture to expand back into cylinder P and force top piston surface R away from air intake valves A for repeated power strokes. The cooling fins F shown in FIG. 4 are used for cooling cylinder P.

Figure 5:
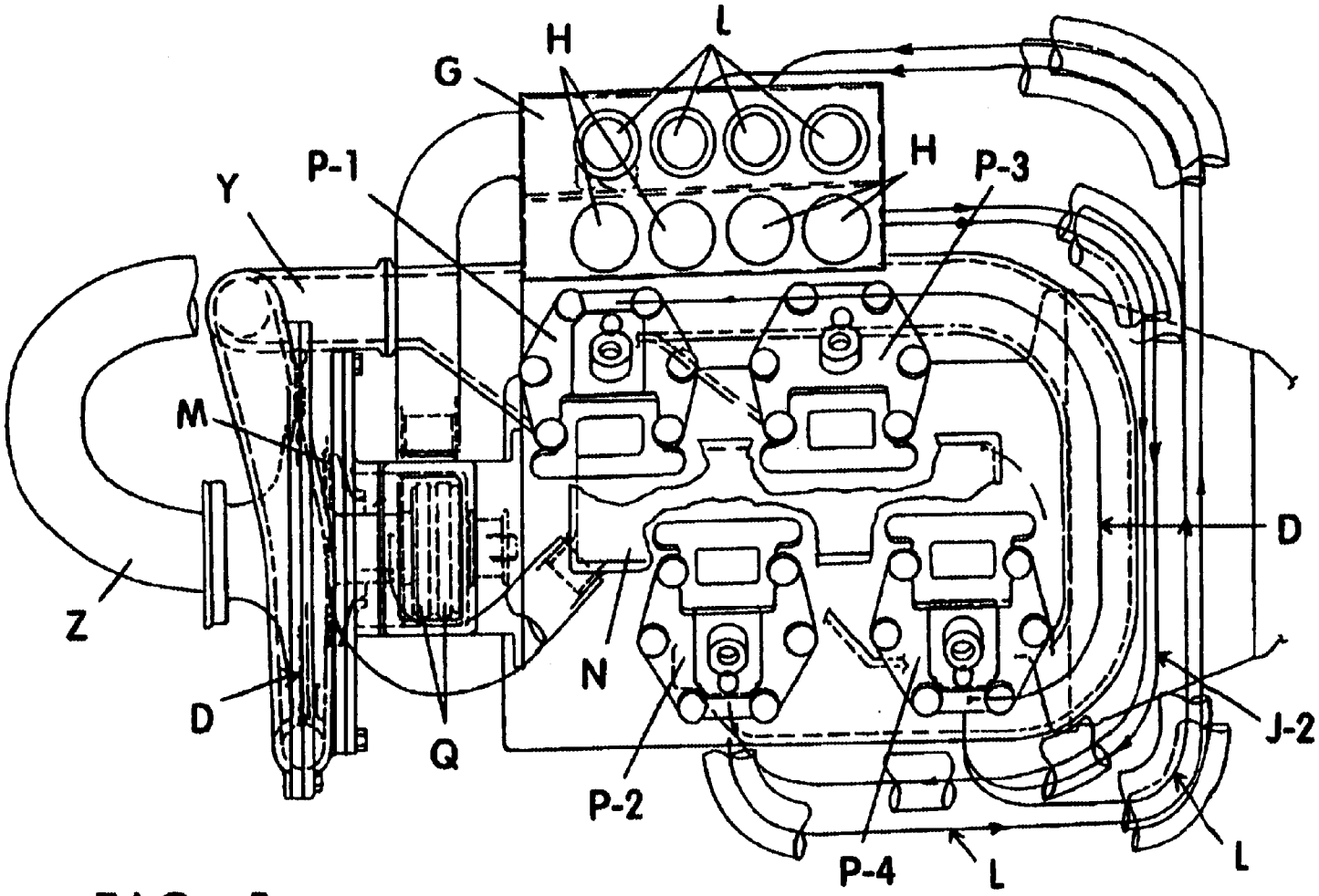
FIG. 5 is a plan view of the most preferred embodiment of the present invention engine.

FIG. 5 is a plan view of the most preferred embodiment of the present invention engine, showing the relative locations of four cylinders, P-1, P-2, P-3, and P-4. Impeller/turbine D, air box N, and air filter G are respectively identified relative to cylinders P-1, P-2, P-3, and P-4. FIG. 5 further shows air strainers H pre-treating air before it enters cylinders P-1, P-2, P-3, and P-4, and tubing L returning the hot exhaust from cylinders P-1, P-2, P-3, and P-4 to air filter G. In addition, FIG. 5 shows the positioning of impeller/turbine D, blower M, compressor V-belt Q, and the exhaust to atmosphere Z relative to cylinders P-1, P-2, P-3, and P-4.

What is claimed is:

1. A reversible heat, constant pressure two-cycle engine comprising:

at least one pistons, said at least one piston being movable within a cylinder so as to create a power stroke;

an igniter communicating with said cylinder;

a fuel delivery system also communicating with said cylinder;

a venturi communicating with said cylinder and said igniter, said venturi being configured for eduction of fuel from said fuel delivery system via hot air compressed by said piston and forced to travel through said venturi toward said igniter;

a blower assembly configured for providing hot air into said cylinder for combustion;

a plurality of exhaust ports configured for eliminating exhaust gases from said cylinder after combustion; and an air intake valve positioned between said blower assembly and said cylinder, said air intake valve further being configured for opening and closing as a result of air pressure differential for fast and silent operation with air pressure cushioning on one side of said air intake valve being provided by said blower assembly and the air pressure cushioning on the other side of said air intake valve being provided by power stroke compression pressure.

2. The engine of claim 1 wherein said blower assembly and said air intake valve are configured for introducing very hot air into said cylinder, maintaining the very hot air under pressure within said cylinder, and preventing the very hot air from expanding prior to being mixed with fuel and ignition.

3. The engine of claim 2 further comprising a crankshaft that is configured for providing movement of said piston between power strokes, said crankshaft being offset by approximately one-half inch so that when said igniter is fired said crankshaft is already past top dead center and should pre-ignition of the combined fuel and heated air mixture occur, the energy created thereby contributes to the power stroke instead of being adverse to it, and whereby fuel can be burned at a very lean mixture, all of the fuel in each power stroke is burned, and the resulting exhaust is clean.

4. The engine of claim 3 further comprising an impeller and wherein said impeller is driven by the exhaust eliminated at velocity from said cylinder after combustion, with the energy of said impeller being used to turn said crankshaft.

5. The engine of claim 3 wherein said igniter is located above the exact center of the top of said piston and said igniter fires constantly so that timing of said igniter is self determined and prevents a need for advance setting and variable control devices.

6. The engine of claim 5 further comprising a plurality of cooling fins associated with said cylinder, wherein said blower assembly is run by said engine, and further wherein said blower assembly directs hot air from said cooling fins to said cylinder for combustion.

7. The engine of claim 1 further comprising a crankshaft that is configured for providing movement of said piston between power strokes, said crankshaft being offset by approximately one-half inch so that when said igniter is fired said crankshaft is already past top dead center and should pre-ignition of the combined fuel and heated air mixture occur, the energy created thereby contributes to the power stroke instead of being adverse to it.

8. The engine of claim 1 further comprising a low-pressure fuel pump communicating with said fuel delivery system.

9. The engine of claim 1 wherein said igniter fires constantly so that timing of said igniter is self determined and prevents a need for advance setting and variable control devices.

10. The engine of claim 1 wherein said igniter is located above the exact center of the top of said piston, so as to eliminate a flame front.

11. A reversible heat, constant pressure two-cycle engine comprising:

at least one cylinder having a combustion chamber with a top opening and at least one exhaust port located remotely from said top opening;

a piston movable within said at least one cylinder, having a top surface, and being configured and dimensioned for revealing said at least one exhaust port at the end of a power stroke;

an igniter communicating with said top opening;

a fuel delivery system positioned between said top opening and said igniter;

a venturi also positioned between said top opening and said igniter, said venturi being configured so that hot air compressed by said piston and forced to travel through said venturi toward said igniter educts fuel from said fuel delivery system;

a blower assembly configured for providing hot air into said at least one cylinder; and an air intake valve positioned between said blower assembly and said combustion chamber, said air intake valve being incapable of softening after heating and configured for opening and closing as a result of pressure differential, whereby when said air intake valve is closed, hot compressed induction air is forced by said piston into said venturi, the velocity of the hot air educts fuel from said fuel delivery system and drives the combustible fuel-air mixture to said igniter, where the fuel-air mixture flow changes from laminar to turbulent and ignition occurs, after which the combustible mixture expands into said combustion chamber, is leaned with the air in said combustion chamber, expands with great pressure rise, and is forced onto said top surface of said piston producing a power stroke, the lean burn also permitting the complete burning of the fuel to eliminate emissions from said exhaust ports, the exhaust gases exit said ports at velocity and create the pressure decay in said at least one cylinder that is responsible for opening said air intake valve to allow fresh air to again enter said at least one cylinder for the next power stroke.

12. The engine of claim 11 further comprising a crankshaft configured for providing movement of said piston between power strokes, said crankshaft being offset by approximately one-half inch so that when said igniter is fired said crankshaft is already past top dead center and whereby when pre-ignition of the combined fuel and heated air mixture occurs, the energy created thereby contributes to the power stroke instead of being adverse to it.

13. The engine of claim 12 further comprising a low-pressure fuel pump communicating with said fuel delivery system and an impeller, and wherein said impeller is driven by the exhaust eliminated at velocity from said at least one cylinder after combustion, with the energy of said impeller being used to turn said crankshaft.

14. The engine of claim 11 wherein said blower assembly and said air intake valve are configured for inducting very hot air into said at least one cylinder, maintaining the very hot air under pressure within said at least one cylinder, and preventing the very hot air from expanding prior to being mixed with fuel and ignition.

15. The engine of claim 11 wherein said igniter fires constantly so that timing of said igniter is self determined and prevents a need for advance setting and variable control devices.

16. The engine of claim 11 wherein said igniter is located above the exact center of the top of said piston.

17. A method for manufacturing a reversible heat, constant pressure two-cycle engine, said method comprising the steps of:

providing at least one cylinder with at least one upper air intake opening, at least one lower exhaust opening, and a top air compression opening, also providing a piston, an igniters, a fuel delivery system, a venturi, a blower assembly, and an air intake valves for use with said at least one cylinder;

pairing said piston said at least one cylinder so that said piston is movable within said at least one cylinder;

associating said igniter said at least one cylinder so that said igniter communicates with said top air compression opening;

associating said fuel delivery system and said venturi with said at least one cylinder so that said fuel delivery system and said venturi both communicate with said top air compression opening and said igniter, and further so that said venturi is positioned to allow compressed air passing through said top air compression opening to educt fuel from said fuel delivery system;

positioning said blower assembly in fluid communication with said at least one upper air intake opening of said at least one cylinder; and positioning said air intake valve between said blower assembly and said at least one cylinder so that said air intake valve is movable between an open position that allows hot air flow through said at least one air intake opening and a closed position that prevents hot air flow through said at least one air intake opening, and further wherein said air intake valve is adapted for opening and closing as a result of pressure differential;

whereby when said air intake valve is closed, hot compressed induction air within said at least one cylinder is forced by said piston into said venturi, the velocity of the hot air passing through said venturi educts fuel from said fuel delivery system and drives the fuel-air mixture to said igniter where the fuel-air mixture flow changes from laminar to turbulent and ignition occurs, after which the fuel-air mixture expands into said at least one cylinder, is leaned with the air therein, expands with great pressure rise, and is forced onto the top of said piston producing a power stroke, the lean burn also permitting the complete burning of the fuel to eliminate emissions in the exhaust leaving said at least one cylinder through said at least one lower exhaust opening, the exhaust gases exiting said at least one cylinder at velocity creating the pressure drop that is responsible for opening said air intake valve to allow a fresh charge of hot air to again enter said at least one cylinder for the next power stroke.

18. The method of claim 17 further comprising the steps of providing a crankshaft configured and positioned for movement of said piston between power strokes, connecting said crankshaft to said piston, and offsetting said crankshaft by approximately one-half inch past top dead center.

19. The method of claim 18 further comprising the steps of providing a low-pressure fuel pump as a part of said fuel delivery system, positioning said pump so that it communicates with the remaining portions of said fuel delivery system, providing an impeller, and positioning said impeller so that it is driven by the exhaust eliminated at velocity from said at least one cylinder after combustion and the energy of said impeller is used to turn said crankshaft.

20. The method of claim 17 wherein said blower assembly and said air intake valve are configured for inducting very hot air into said at least one cylinder, maintaining the very hot air under pressure within said at least one cylinder, and preventing the very hot air from expanding prior to being mixed with fuel and ignition.

* * * * *